US005486425A

United States Patent [19]

Seibert

[11] Patent Number: 5,486,425

[45] **Date of Patent: * Jan. 23, 1996**

[54] SHOOTING RANGE TARGET

[76] Inventor: George M. Seibert, 36591 Haverhill St., Sterling Heights, Mich. 48312

[ * ] Notice: The portion of the term of this patent subsequent to Apr. 11, 2012, has been disclaimed.

[21] Appl. No.: 139,845

[22] Filed: Oct. 22, 1993

Related U.S. Application Data

[63] Continuation-in-part of Ser. No. 40,140, Mar. 30, 1993, Pat. No. 5,405,673.

[51] Int. Cl.[6] ..... B32B 3/10; A63B 67/00; F41H 5/02

[52] U.S. Cl. ..... 428/500; 428/521; 428/523; 428/912; 273/318; 273/348; 89/36.02

[58] Field of Search ..... 428/156, 172, 428/182, 252, 246, 500, 521, 523, 912; 273/317, 346, 348, 318, 410; 89/36.01, 36.02

[56] References Cited

U.S. PATENT DOCUMENTS

| | | | |
|---|---|---|---|
| 3,895,803 | 7/1975 | Loe | 273/102 R |
| 4,678,702 | 7/1987 | Lancaster et al. | 428/252 |
| 4,810,561 | 3/1989 | King | 428/195 |
| 4,944,906 | 7/1990 | Colby et al. | 264/101 |
| 5,190,802 | 3/1993 | Pilato | 428/111 |

OTHER PUBLICATIONS

"Surlyn®Product Guide", Dupont Co. H–24231 (Mar. 1990).

*Primary Examiner*—Donald J. Loney
*Attorney, Agent, or Firm*—Gifford, Krass, Groh, Sprinkle, Patmore, Anderson & Citkowski

[57] ABSTRACT

A self-sealing target for firearm projectiles includes a body of an ionomeric polymer. A preferred polymer is a metallic salt of a copolymer of ethylene and a vinyl monomer having an acidic group.

10 Claims, 1 Drawing Sheet

FIG - 1
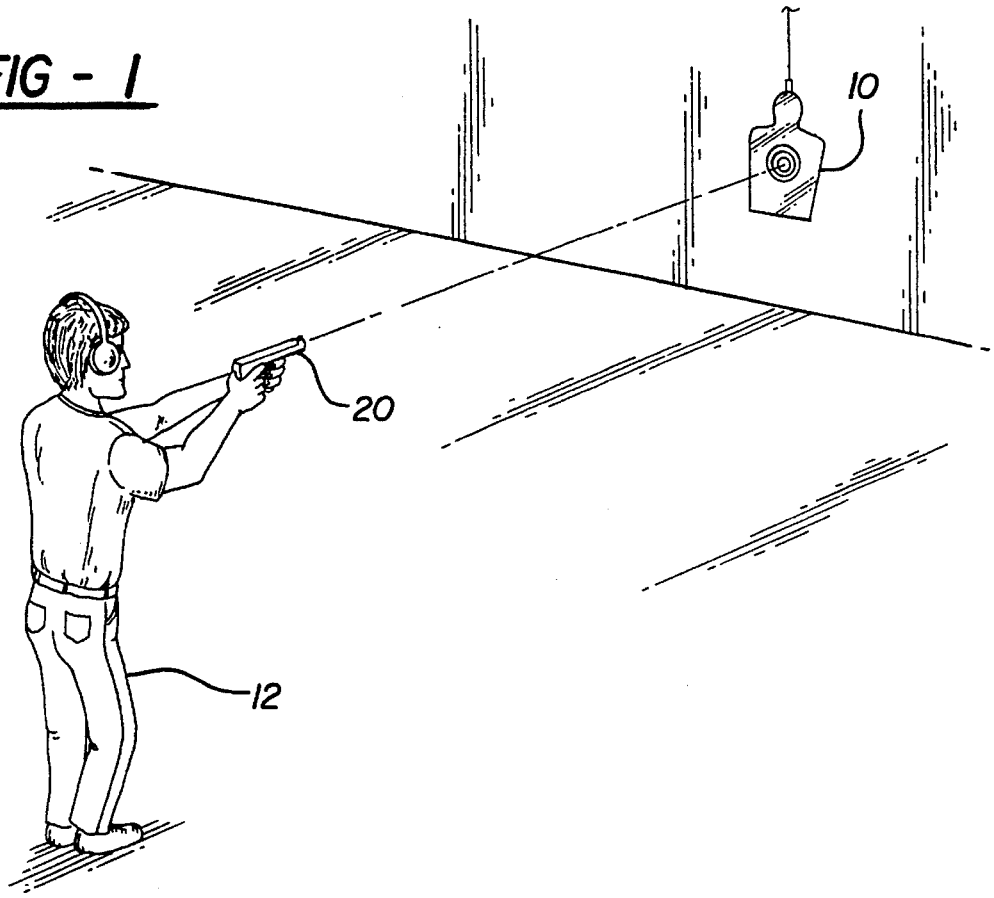
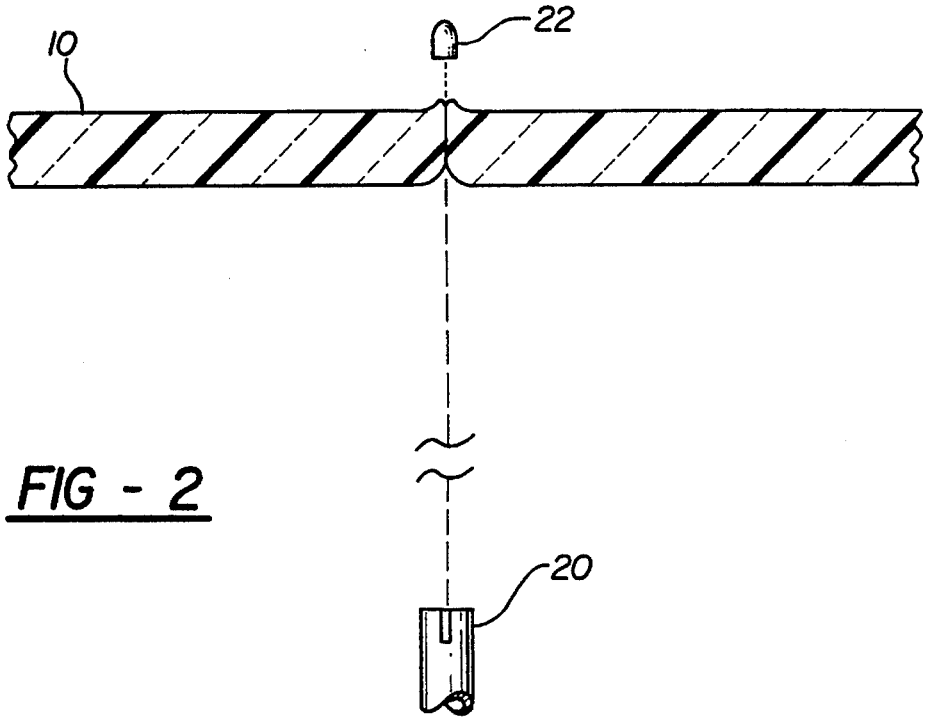
FIG - 2

SHOOTING RANGE TARGET

This application is a continuation-in-part of U.S. patent application Ser. No.08/040,140, filed mar. 30, 1993 U.S. Pat. No. 5,405,673.

FIELD OF THE INVENTION

This invention relates generally to target shooting. More particularly, the invention relates to target structures for shooting ranges.

BACKGROUND OF THE INVENTION

Target shooting is a widespread activity, both for purposes of recreation and in connection with the training of law enforcement officers, military personnel and individuals interested in personal self-defense. Target ranges provide a safe and controlled environment for year-around shooting. Furthermore, target ranges minimize the impact of noise and the hazards of stray projectiles on the surrounding environment; hence, they are of increasing popularity in urban areas.

Targets generally used at shooting ranges are of a solid, bullet penetrable material used typically to support a removable paper target thereon with appropriate indicia such as the well known circular "bulls-eye" target. Other target structures often used for military or police training applications may take specific shapes or silhouettes and may also have indicia or aiming points thereon. Many such target structures are incorporated into mechanical systems which cause them to "pop-up" for the shooter to shoot at. The mechanical system may also cause the targets to fall down when the appropriate aiming point is hit.

In any target range, and in an indoor range in particular, it is necessary to provide a target structure which will allow projectiles to penetrate the target and pass into a bullet trapping structure without damage or hazard from ricochets or bullet fragments. By the same token, it is desirable to have a target structure which can withstand a large number of bullet penetrations while substantially maintaining the target integrity, thus allowing the target to be used on a continued and repeated basis for a substantially longer period of time without the need for replacement.

Wood, cardboard, fiberboard and other rigid penetrable structures have long been employed in shooting ranges to serve as targets. Each penetration through such targets results in the removal of a portion of the target material and creates a corresponding hole in the target, hence these target structures quickly lose their integrity and consequently their ability to function as a target. Polyethylene structures have also been used as targets and provide improved performance over wood and other materials. However, each penetration still removes material from the structure, resulting in the need for target replacement after repeated penetrations.

It will be appreciated from the foregoing that there is a need for an improved target structure which will allow repeated bullet penetrations without sustaining substantial damage and loss of integrity. The present invention addresses this need by providing a self healing target structure which effectively allows penetration by a variety of calibers and loads, without any significant loss of the target material and without significant damage to the structure. These and other advantages of the present invention will be readily apparent to those of skill in the art from the drawings, discussion and description which follow.

BRIEF DESCRIPTION OF THE INVENTION

There is disclosed herein a target structure for firearm projectiles. The structure is composed of an ionomer of the type comprising a metallic salt of a copolymer of ethylene and a vinyl monomer having an acidic group. It has been found, in accord with the principles of the present invention, that this ionomeric material is very effective at slowing and absorbing the impact from bullets, and that a bullet penetrating the material will initially stretch the material and form an opening which is self healing in that it reseals itself after the bullet has passed. The ionomeric body may be made in any appropriate shape or form with appropriate target indicia thereon or it may simply be employed to support a paper or other disposable target thereon. The ionomeric material may also be used to cover exposed target stand structures to absorb bullet impact and prevent fragment splatter by absorbing bullet fragments caused by impact with the target stand.

In one particular embodiment, the ionomer comprises a sodium or zinc salt of a copolymer of ethylene and methacrylic acid. In some instances the ionomeric material may further include a layer of aramide polymer laminated thereto.

BRIEF DESCRIPTION OF THE DRAWINGS

FIG. 1 is a perspective view of a target of a structure in accord with the present invention; and FIG. 2 is a top plan view of a shooting range including a target structured in accord with the present invention.

DETAILED DESCRIPTION OF THE INVENTION

FIG. 1 illustrates a shooting range target 10 structured in accord with the principles of the present invention as will be more fully described hereinbelow. Also shown in FIG. 1 is a shooter 12 shooting a firearm 22 at the target. Referring now to FIG. 2, there is shown a top plan view of a shooting range which includes a target 10 structured in accord with the principles of the present invention. Also shown in FIG. 2 is a firearm 20 and projectile 22 fired from the firearm. The target 10 is fabricated from a type of polymer referred to as an ionomer. This material comprises a metallic salt of a copolymer of an olefin such as ethylene and a vinyl monomer having an acidic grouping thereon. In an ionomer, linkage of the polymeric chain is accomplished by ionic as well as covalent bonds. It has been found, in accord with the principles of the present invention, that ionomeric polymers are very effective at absorbing the kinetic energy of bullets. It has been found that a bullet passing through a sheet of ionomeric polymer will initially stretch the material and form an opening which reseals itself after the bullet has passed.

One ionomeric polymer having particular utility in the present invention is the sodium or zinc salt of a copolymer of ethylene and methacrylic acid. Materials of this type are available under the designation Surlyn® from the DuPont Corporation. The material sold under the grade designation 8940 has been found to be particularly advantageous for fabricating targets. This material includes the sodium cation and it has a nominal density of 0.95 g/cm$^3$; a melt flow index of 2.8 g/10 minutes per ASTM D-1238; a notched izod toughness of 1025 J/cm per ASTM D-256; a tensile impact of 1020 kJ/m$^2$ at 20° and 760 kJ/m$^2$ at –40° C. per ASTM D-1822s; it has a flexural modulus of 350 MPa at 23° C. per ASTM D-790; a tensile of strength 33.1 MPa, a yield strength of 15.9 MPa and an elongation of 470% all per ASTM D-638. Its shore D hardness is 65 per ASTM D-2240. The melting point of this polymer per data analysis is approximately 81°–96° C. and its freezing point is approximately 51°–80°.

Other grades of Surlyn® polymer, particularly grade 8920 have generally similar properties and are also usable in the practice of the present invention. In those instances where low temperature conditions are encountered, as for example in outdoor ranges, materials with better low temperature properties, such as Surlyn® 8020, may be employed. It is to be understood that other ionomeric polymers, particularly those having properties similar to those herein described may also be employed in the practice of the present invention. In some instances the ionomeric material may be further modified by the inclusion of fire retardant agents, coloring agents and the like. The ionomeric material may also include a fabric layer laminated thereto to facilitate the painting of appropriate target indicia thereon. One fabric having particular utility in this regard is comprised of a ,polyester nonwoven fabric available under the trade name Reemay® by DuPont. The fabric is preferably extrusion laminated onto the surface of the ionomeric material.

In the illustrated embodiment the shooter 12 is firing a firearm 20 at target 10. As the bullet 22 penetrates the target a hole is created in the target 10 which reseals once the penetration is complete. The bullet 22 is then stopped by a backstop.

Target 10 may include a steel fabricated target support structure or stand and may also employ mechanical systems which move the target up and down to simulate a object popping up and down from behind cover. The cover may also be fabricated from a steel plate. One or more sheets of ionomeric material may be used to cover or clad the target support structure and/or steel plate to prevent dangerous bullet fragments from ricocheting and striking shooter or bystanders. As bullet 22 penetrates the ionomeric material striking the target support structure or steel plate, resulting bullet fragments are absorbed by the ionomer and prevented from splattering. As bullet 22 penetrates or misses the target, target 10 may itself also act as a splatter preventing curtain preventing dangerous bullet fragments and dust resulting from impact on a backstop from reaching the shooter. The ionomeric material may also be used as a non-target curtain placed between the target and the backstop in order to prevent splattering.

The backstop may also be constructed of an ionomeric polymer and may comprise a plurality of separate sheets of ionomeric material as disclosed in U.S. patent application Ser. No. 08/040,140, filed Mar. 20, 1992, entitled "Shooting Range Backstop."

Preferably the thickness of target 10 ranges from 0.125 inches to approximately 0.500 inches. In a series of practical test employing Surlyn® 8940 of 0.250 inch thickness, it was found that a 0.380 caliber jacketed solid-point bullet fired at 90° to an array of 0.250 inch sheets would pass through two sheets and be stopped by a third. Under the same conditions, in a 9 mm jacketed solid-point bullet required six 0.250 inch sheets to stop it. When the 9 mm bullet was fired at a 45° angle to the sheets, it was stopped by the fourth.

It will be appreciated from the foregoing that a highly efficient target for firearm projectiles may be fabricated by employing a body of ionomeric material as a penetrable bullet slowing member. The target may employ an ionomeric member of a desired size and shape and may have desired target indicia or aim points painted thereon. The ionomeric material may also be vacuum formed into a three dimensional structure of a particular desired size and shape such as a humanoid shape for use in military or police training application. The target structure may also be employed as part of a pop-up type target system in which a mechanical system raises and lowers the target, and in some instances scores hits. The target may also simply serve as a support structure for a paper or other disposable target attached thereto. Therefore, it is to be understood that the invention may be practiced in particular forms which differ from the ones disclosed herein. The drawings, discussion, description and example set forth herein are merely meant to illustrate particular embodiments of the invention and are not meant to be limitations on the practice thereof. It is the claims, including all equivalents, which define the scope of the invention.

I claim:

1. A target for firearm projectiles including a body of an ionomeric material comprising a metallic salt of a copolymer of ethylene and a vinyl monomer having an acidic group, said body being operable, when penetrated by a bullet to first stretch and deform and then to form an opening therethrough which reseals after the bullet has passed and including a target support structure for retaining said body of ionomeric material.

2. A target as in claim 1 wherein said ionomeric material comprises a metallic salt of a copolymer of ethylene and methacrylic acid.

3. A target as in claim 1, wherein said metallic salt is selected from the group consisting of: sodium salts, zinc salts, and combinations thereof.

4. A target as in claim 1 wherein said target has indicia thereon.

5. A target as in claim 1 wherein said target is a pop-up target.

6. A target as in claim 1 wherein said target approximates the silhouette of a human figure.

7. A target as in claim 1 wherein said target is a three dimensional shape.

8. In a shooting range target system which includes a metal target stand wherein the improvement comprises in combination:

a body of an ionomeric material comprising a metallic salt of a copolymer of ethylene and a vinyl monomer having an acidic group, disposed so as to cover at least a portion of said metal target stand so that a projectile fired from a firearm penetrates the body of ionomeric material prior to impact with the target stand, whereby said body of ionomeric material prevents the splatter of projectile fragments.

9. A target system as in claim 8 wherein said ionomeric material comprises a metallic salt of a copolymer of ethylene and methacrylic acid.

10. A target system as in claim 8, wherein said metallic salt is selected from the group consisting of: sodium salts, zinc salts, and combinations thereof.

* * * * *

UNITED STATES PATENT AND TRADEMARK OFFICE

CERTIFICATE OF CORRECTION

PATENT NO. : 5,486,425

DATED : January 23, 1996

INVENTOR(S) : George M. Seibert

It is certified that error appears in the above-indentified patent and that said Letters Patent is hereby corrected as shown below:

Column 3, line 22, please delete ",polyester" and insert --polyester--.

Column 4, line 23, delete "including" and insert --consisting essentially of--;

line 24, after the word "material", insert --said body having a thickness in the range of 0.125 inches to 0.500 inches--.

Signed and Sealed this

Thirteenth Day of August, 1996

*Attest:*

Bruce Lehman

BRUCE LEHMAN

*Attesting Officer*

*Commissioner of Patents and Trademarks*